US008197668B2

(12) United States Patent
Ou et al.

(10) Patent No.: US 8,197,668 B2
(45) Date of Patent: Jun. 12, 2012

(54) PROCESS AND APPARATUS FOR UPGRADING STEAM CRACKER TAR USING HYDROGEN DONOR COMPOUNDS

(75) Inventors: John D. Y. Ou, Houston, TX (US); Glenn A. Heeter, The Woodlands, TX (US); Paul F. Keusenkothen, Houston, TX (US); James N. McCoy, Houston, TX (US); Judith Hey, legal representative, Morristown, NJ (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 417 days.

(21) Appl. No.: 12/499,999

(22) Filed: Jul. 9, 2009

(65) Prior Publication Data

US 2011/0005970 A1 Jan. 13, 2011

(51) Int. Cl.
*C10C 3/02* (2006.01)

(52) U.S. Cl. ..... 208/67; 208/49; 208/50; 208/72; 208/106; 208/128; 208/129; 208/130; 208/131; 208/132

(58) Field of Classification Search ..... 208/106, 208/128–132, 49–50, 67, 72, 75–77
See application file for complete search history.

(56) References Cited

U.S. PATENT DOCUMENTS

| | | | | |
|---|---|---|---|---|
| 2,873,245 | A | 2/1959 | Thompson et al. | |
| 3,691,058 | A | 9/1972 | Hamner et al. | |
| 3,707,459 | A | 12/1972 | Mason et al. | |
| 4,430,197 | A | 2/1984 | Poynor et al. | |
| 4,814,065 | A | 3/1989 | Rankel | |
| 5,045,174 | A * | 9/1991 | Grenoble | 208/57 |
| 5,215,649 | A | 6/1993 | Grenoble et al. | |
| 6,187,172 | B1 | 2/2001 | Plummer | |
| 6,190,533 | B1 | 2/2001 | Bradow et al. | |
| 2007/0007170 | A1 * | 1/2007 | Strack et al. | 208/106 |
| 2007/0163921 | A1 * | 7/2007 | Keusenkothen et al. | 208/6 |
| 2009/0057200 | A1 * | 3/2009 | Leta et al. | 208/132 |

FOREIGN PATENT DOCUMENTS

DE 43 08 507 3/1992

OTHER PUBLICATIONS

Speight, J.G. (1999). The Chemistry and Technology of Petroleum, 3rd ed., Marcel-Dekker, 918 pgs.*
U.S. Appl. No. 12/023,204, filed Jan. 31, 2008, Ou et al.
U.S. Appl. No. 12/099,971, filed Apr. 9, 2008, Ou et al.
U.S. Appl. No. 12/112,704, filed Apr. 30, 2008, Keusenkothen.
U.S. Appl. No. 12/486,813, filed Jun. 18, 2009, Ou et al.

* cited by examiner

*Primary Examiner* — Walter D Griffin
*Assistant Examiner* — Brian McCaig
(74) *Attorney, Agent, or Firm* — Gerard J. Hughes; Rick F. James

(57) ABSTRACT

A process and apparatus are provided for upgrading steam cracker tars from steam crackers. The invention also relates to a steam cracking process and apparatus for reducing yields of tars produced from steam cracking while increasing yields of higher value products by heating steam cracker tar, in the presence of hydrogen donor compounds, e.g., tetralin. The hydrogen donor compounds can be provided in a hydrogen donor-rich hydrocarbon stream, e.g., light cycle oils, or low sulfur vacuum tower bottoms. The treated tar can be separated into gas oil, fuel oil and tar streams.

17 Claims, 1 Drawing Sheet

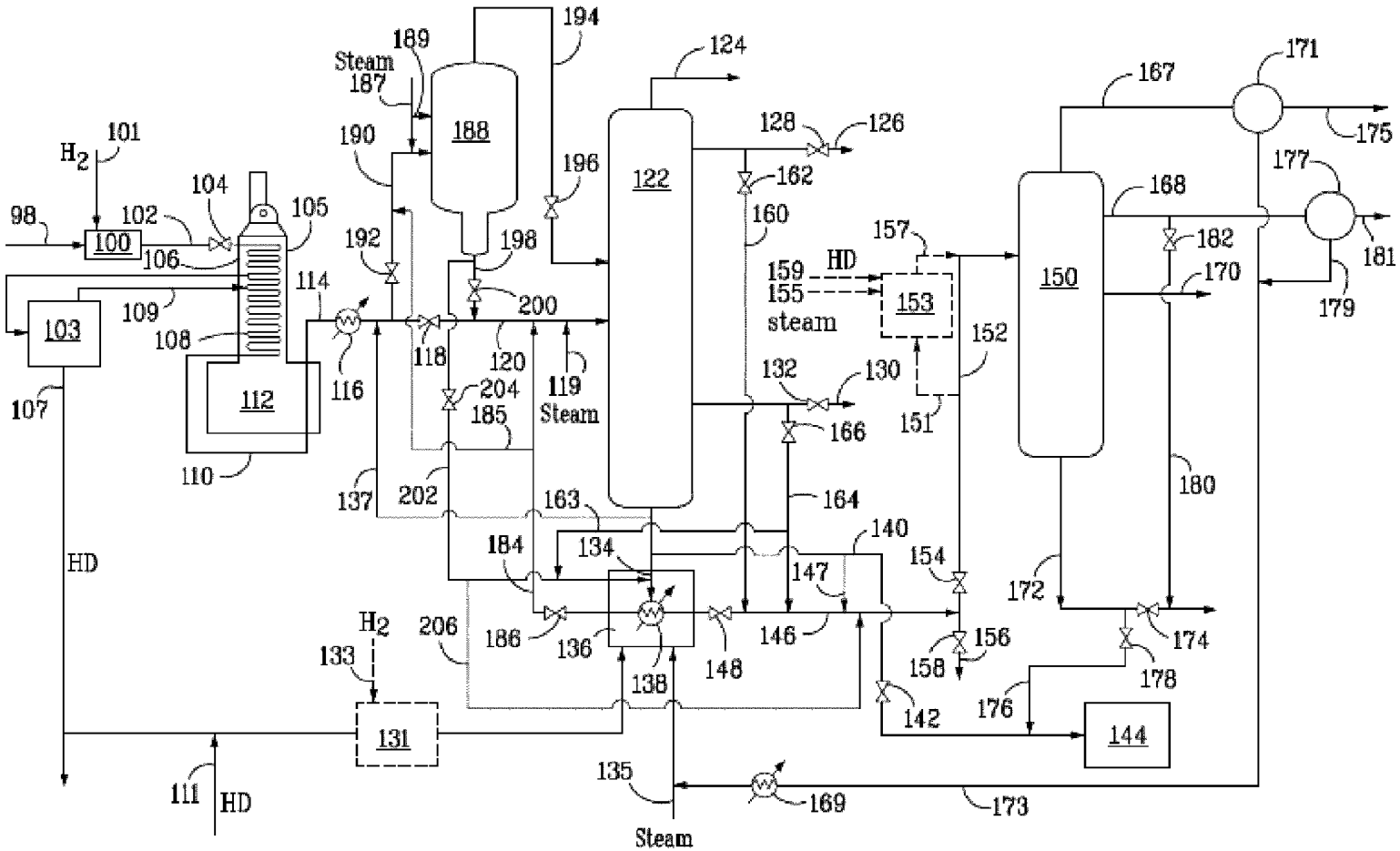
150
144
122
188
112
100
103
131
153
HD
steam
Steam
$H_2$

PROCESS AND APPARATUS FOR UPGRADING STEAM CRACKER TAR USING HYDROGEN DONOR COMPOUNDS

FIELD OF THE INVENTION

The present invention relates to the cracking of hydrocarbons, especially with hydrocarbon feeds containing relatively non-volatile hydrocarbon components that can produce steam cracker tar as a steam cracking product. More particularly, the present invention relates to a cracking process and apparatus that treats steam cracker tar fractions by exposure to heat in the presence of hydrogen donor compounds to prevent or decrease formation of at least a portion of high boiling molecules, including asphaltenes and/or asphaltene precursors, within the effluent stream. Exemplary high boiling molecules and precursors may include tar and asphaltenes.

BACKGROUND OF THE INVENTION

Steam cracking is used to crack various hydrocarbon gaseous (e.g., light alkanes) or liquid (e.g., naphthas) feedstocks into higher value products, such as olefins, preferably light olefins such as ethylene and propylene. In addition to naphthas, other liquid feedstocks of interest may include, for example, distillation residues or bottoms, gas oils, kerosenes, crudes, various other liquid separation product streams, and blends thereof. When steam cracking liquid feedstocks having final boiling points higher than naphthas, the process often produces undesirable by-products, such as various aromatic compounds, ash, metals, coke, asphaltenes, and other high weight materials including molecules that tend to combine to form high molecular weight materials commonly known as tar. Similarly, cracking heavier liquid feedstocks (e.g., feeds having a final boiling point above 260° C.) generally produces more tar and asphaltenes than lighter liquid feeds such as naphthas. The term "final boiling point above X" means that at temperature X, a sample of the material still exhibits at least some non-volatized portions, at least a further portion of which may still be volatized at a temperature greater than X.

Tar is a high boiling point, viscous, reactive material comprising many complex, ringed and branched molecules that can polymerize and foul equipment under certain conditions. Tar also typically contains high-boiling and/or non-volatile components including paraffin-insoluble compounds, such as pentane-insoluble (PI) compounds or heptane-insoluble (HI) compounds, which are molecules of high molecular weight, multi-ring structures, collectively referred to as asphaltenes. Asphaltene accumulation or build-up can progress for a time under various post-cracking conditions, particularly as the steam cracker effluent cools, especially as the tar-containing effluent cools below 300° C.

Tar and associated asphaltenic materials can precipitate, build up in, and plug piping, vessels, and related equipment downstream of the cracking furnace. Further, asphaltenic materials reduce the economic value and further processability of tar by rendering the tar highly viscous and less compatible for mixing or blending with highly paraffinic streams or for use with fuel streams. When so blended, the paraffinic streams and asphaltenes can further induce precipitation of the paraffin-insoluble components in the resulting mixture. Various methods are known in the art to treat tars, such as those produced from steam cracking liquid feedstocks.

U.S. Pat. No. 2,873,245, incorporated herein by reference in its entirety, discloses hydrogen donor diluent cracking of heavy oil, e.g., vacuum residuum, and treating the resulting gas oils in a catalytic cracker. U.S. Pat. No. 3,691,058, incorporated herein by reference in its entirety, discloses an integrated visbreaking-hydrocracking process to break down steam cracker tars into single-ring aromatics. U.S. Pat. No. 3,707,459, incorporated herein by reference in its entirety, discloses visbreaking residua, e.g., thermal tar from steam cracking, in the presence of free radical acceptors, e.g., CaO, isooctane, and n-heptane. U.S. Pat. No. 4,430,197, incorporated herein by reference in its entirety, discloses treating thermal cracker feed with hydrogen donor solvent, separating and rehydrogenating spent hydrogen donor solvent with recycle to the cracking step, and heat soaking the pitch fraction from the cracked products to reduce pentane insolubles with recycle to the cracking step.

U.S. Pat. No. 4,814,065, incorporated herein by reference in its entirety, discloses accelerating hydrogen exchange between a hydrogen donor and a petroleum resid feed for cracking, visbreaking, or coking, by adding aqueous ammonium sulfide and heat soaking. U.S. Pat. No. 5,215,649, incorporated herein by reference in its entirety, discloses producing gaseous olefins by cracking a hydrocarbon feedstock stream wherein the cracked product stream is quenched to stop cracking, followed by injecting hydrogen donor diluent, e.g., dihydronaphthalenes, which suppress molecular weight growth reactions forming undesirable high molecular weight materials such as asphaltenes. U.S. Pat. No. 6,187,172, incorporated herein by reference in its entirety, discloses treating asphaltene-containing feeds to reduce viscosity by adding an asphaltene dispersant such as tetralin or furan. U.S. Pat. No. 6,190,533, incorporated herein by reference in its entirety, discloses converting hydrocarbons such as visbreaker oil or deasphalted oil into steam cracked products by hydrotreating to remove organic sulfur and/or nitrogen compounds, and then passing to a steam cracking zone.

DE 4308507 discloses reducing viscosity of heavy oil residues by treatment at high temperature (427° C.) with a hydrogen donor solvent comprising a fuel oil from steam cracking, which contains hydroaromatic compounds. U.S. application Ser. No. 12/023,204, filed Jan. 31, 2008, discloses upgrading steam cracker tar by heating from below 300° C. to a temperature above 300° C. for a time sufficient to convert at least a portion of the steam cracker tar to lower boiling molecules. U.S. application Ser. No. 12/099,971, filed Apr. 9, 2008, discloses upgrading steam cracker tar by heating from below 300° C. to a temperature above 300° C. and in the presence of steam for a time sufficient to convert at least a portion of the steam cracker tar to lower boiling molecules and separating the heated steam cracker tar into a tar-lean product and a tar-rich product boiling above the tar-lean product. U.S. application Ser. No. 12/112,704, filed Apr. 30, 2008, discloses a process and apparatus for steam cracking heavy feeds, including steam cracked tars. A steam cracked tar feed is heated to provide a depolymerized steam cracked tar containing lower boiling molecules than the steam cracked tar feed. U.S. application Ser. No. 12/486,813, filed Jun. 18, 2009, discloses upgrading steam cracker tar in the presence of steam for a time sufficient to convert steam cracker tar to lower boiling molecules which reduces yields of tars from steam cracking while increasing yields of higher value products.

SUMMARY OF THE INVENTION

It is desirable to provide an apparatus and process to either prevent initial formation or growth of asphaltenes within the tar and/or to enable conversion of an improved fraction of the steam cracker tar to more valuable, lower boiling materials. Moreover, it is also desirable to provide such apparatus and processes that are self-contained to upgrade steam cracker tars by efficiently managing the introduction of hydrogen donor compound additives to steam cracker tar-containing streams, particularly under conditions which prevent coking of downstream separators and associated piping. In particular, it would be advantageous to provide apparatus and processes that contact steam cracker tar-containing streams at one or more locations downstream of a steam cracker radiant section effluent outlet to contain or prevent tar and/or asphaltene formation.

It has recently been learned that the tar and asphaltene yield from a steam cracking process can be substantially reduced and that the asphaltene content of the remaining tar can also be substantially reduced by contacting hot, steam cracker tar with hydrogen donor compounds added at selected locations downstream of a steam cracker furnace. Preferably, at least a portion of any of the molecules thus formed may also be reduced to lower boiling fractions. The resulting hydrogen donor compound-treated tar and tar-containing effluent can be separated to produce improved percentages of higher value, lower-boiling streams such as naphthas, gas oils, fuel oils, etc., as compared to untreated streams.

In one aspect, the present invention relates to a process for upgrading tar-containing effluent from a steam cracker furnace comprising: a) feeding a hydrocarbon feedstock having a final boiling point above 260° C. to a steam cracking furnace containing a radiant section outlet producing a steam cracker tar-containing effluent; b) adding a hydrogen donor-rich hydrocarbon stream comprising naphthenic compounds to at least a portion of the steam cracker tar-containing effluent while the tar-containing effluent is at a temperature of from 200° to 850° C., say, to a temperature above 300° C., say, at least 350° C., or even at least 400° C., to form a mixture comprising hydrogen donor-rich hydrocarbons and steam cracker tar-containing effluent; and c) separating the mixture into i) at least one tar-lean product containing a first tar and ii) a tar-rich product containing a second tar, the tar-rich product having a final boiling point above the final boiling point of the at least one tar-lean product.

In a second aspect, the present invention relates to a process for upgrading steam cracker tar which comprises a) hydroprocessing a resid-containing steam cracker feed; b) heating the hydroprocessed steam cracker feed in an upper convection section of a steam cracker furnace; c) separating the heated feed in a flash drum to provide a bottoms stream and an overhead stream; d) directing the overhead stream to a lower convection section and a radiant section of the steam cracker furnace to provide a steam cracker effluent; e) separating the steam cracker effluent into a steam cracker tar bottoms fraction and at least one lower boiling, olefins-containing fraction; f) visbreaking the steam cracker tar in the presence of an added hydrogen donor-rich hydrocarbon stream that can optionally include at least a portion of the bottoms stream from step c), to provide a product of lower viscosity than the steam cracker tar; g) separating the product of lower viscosity into at least one of: a steam cracker gas oil stream, a tar-lean stream, and a tar-rich stream; and h) optionally blending the tar-lean stream and/or the tar-rich stream into a fuel oil pool to provide a fuel oil product.

In another aspect, the present invention relates to an apparatus for upgrading tar-containing effluent from a steam cracker furnace comprising: a) a steam cracker furnace useful for cracking a feedstock having a final boiling point above 260° C., the furnace having a convection section and a radiant section with an outlet for discharging a steam cracker tar-containing effluent from the furnace; b) one or more vessels downstream of the radiant section outlet for further processing the steam cracker tar-containing effluent at temperatures from 200° to 850° C.; c) at least one transfer line for conveying the steam cracker tar-containing effluent from the furnace to or between the one or more vessels downstream of the radiant section outlet; d) at least one line for adding a hydrogen donor-rich hydrocarbon stream to the steam cracker tar-containing effluent downstream from the furnace through a hydrogen donor-rich hydrocarbon stream inlet into the at least one transfer line and/or the one or more vessels, to form a mixture comprising hydrogen donor-rich hydrocarbons and steam cracker tar-containing effluent; and e) at least one separator for separating the mixture into i) at least one tar-lean product containing a first tar; and ii) a tar-rich product containing a second tar, the tar-rich product having a final boiling point above the final boiling point of the at least one tar-lean product, and further wherein the at least one separator optionally comprises a primary fractionator.

In still other aspects, the invention includes a process for upgrading steam cracker tar containing asphaltenes that comprises: a) heating the steam cracker tar from below 300° C. to a temperature above 300° C., say, at least 350° C., or even at least 400° C., in the presence of an added hydrogen donor-rich hydrocarbon stream comprising naphthenic compounds, such that the final boiling point of the resulting mixture is not greater than that of the steam cracker tar; and b) separating the heated steam cracker tar of a) into i) at least one tar-lean product; and ii) a tar-rich product having a final boiling point above that of the tar-lean product.

In another aspect, the present invention relates to a process for upgrading steam cracker tar which comprises: a) hydroprocessing a resid-containing steam cracker feed; b) heating the hydroprocessed steam cracker feed in an upper convection section of a steam cracker furnace; c) separating the heated feed in a flash drum to provide a bottoms stream and an overhead stream; d) directing the overhead stream to a lower convection section and a radiant section of the steam cracker furnace to provide an olefinic gaseous steam cracker effluent; e) separating the steam cracker effluent into a steam cracker tar bottoms fraction and at least one lower boiling, olefin-containing fraction; f) visbreaking the steam cracker tar in the presence of an added hydrogen donor-rich hydrocarbon stream that can optionally include at least a portion of the bottoms stream from step c), to provide a product of lower viscosity than the steam cracker tar; g) separating the lower viscosity product into at least one of: A) a steam cracker gas oil stream, a light tar stream, and a heavy tar stream, and B) a visbreaker naphtha stream and a visbreaker tar stream; and h) optionally blending the light tar stream and/or the visbreaker tar stream into a fuel oil pool to provide a fuel oil product.

BRIEF DESCRIPTION OF THE DRAWING

FIG. 1 depicts an embodiment of a process schematic and apparatus for upgrading tars in a steam cracking plant environment using hydrogen donor compound-containing streams, in accordance with the present invention.

DETAILED DESCRIPTION

Unless otherwise stated, all percentages, parts, ratios, etc. are by weight. Reference to a compound or component includes the compound or component by itself, as well as in combination with other compounds or components, such as mixtures of compounds. Further, when an amount, concentration, or other value or parameter is given as a list of upper preferable values and lower preferable values, this is to be understood as specifically disclosing all ranges formed from any pair of an upper preferred value and a lower preferred value, regardless of whether ranges are separately disclosed.

In one embodiment of the first process aspect of the present invention described in the above "Summary of the Invention," the hydrogen donor-rich hydrocarbon stream is selected from light cycle oil, hydrofined product streams, tetralin, alkyl substituted tetralin, hydrogenated anthracenes, hydrogenated phenanthrenes, hydrogenated pyrenes, bottoms separated from a hydrotreated resid, hydrotreated fractionation tower bottoms, and hydrotreated low sulfur vacuum tower bottoms. The hydrotreated resid can be a steam cracker feed. The feed for the resid hydrotreating process can be from substantially any resid-containing hydrocarbon source. Hydrotreated fractionation tower bottoms may include a hydrotreated product from any of various bottoms products or recoveries from substantially any vapor/liquid or liquid/liquid separation process, such as but not limited to atmospheric distillation tower bottoms, vacuum tower bottoms, low sulfur vacuum tower bottoms, gas-oil products, tar knockout bottoms, primary fractionator bottoms, etc., which are fed to a hydrogenation process. Light cycle oil is also known as light hydrocarbon; LCO; petroleum distillates; CAT cracked distillate, light; light distillate; gas oil, light cracked; kerosene; diesel; and gas oil, light hydrotreated, with a typical flash point of 65.6° C. (150.1° F.), typical boiling point of 166.7° to 354.4° C. (332.1° to 669.9° F.), and typical vapor pressure of 0.009 psia at 21° C. (70° F.). Low sulfur vacuum tower bottoms (LSVTB) are vacuum tower bottoms (VTB) or "resid" which are processed, e.g., by hydrotreating, to contain less than one weight percent sulfur, e.g., less than 0.2 weight percent, or even less than 0.1 weight percent. LSVTB typically boil above 454° C. (850° F.). For present purposes, the term "low sulfur vacuum tower bottoms" also includes bottoms taken from a flash/separation vessel, e.g., tar knockout drum, associated with a steam cracker furnace which is used to reduce or remove resid components in the steam cracker feed upstream of the radiant section of the furnace, given the similar boiling range of such bottoms compared to vacuum tower bottoms.

Processes for hydrotreating heavy, resid-containing feeds are well-known and can utilize catalytic reaction with hydrogen to remove nitrogen, sulfur impurities, and high molecular weight carbon compound-forming materials, as well as for demetallizing heavy feeds. According to the invention a crude or fraction thereof containing resid can be hydroprocessed. This may be by routine hydroprocessing methods, such as those described in the prior art set forth herein. Resid hydroprocessing is conventionally carried out at a temperature of from 260° to 482° C. (500° to 900° F.), preferably 343° to 427° C. (650° to 800° F.). A pressure of from 3549 to 69050 kPa (500 to 10,000 psig), preferably 10444 to 27681 kPa (1500 to 4000 psig) is used, with a liquid hourly space velocity of from 0.1 to 5, preferably 0.15 to 0.5. The hydrogen supply rate (makeup and recycle hydrogen) to the hydroconversion zone is in the range of from 0.07 to 2.88 standard cubic meter per liter of hydrocarbon feed (500 to 20000 standard cubic feet per barrel of hydrocarbon feed), preferably 0.28 to 0.72 standard cubic meter per liter of hydrocarbon feed (2000 to 5000 standard cubic feet per barrel). The hydroprocessing may be carried out utilizing a single zone or a plurality of zones, e.g., two or more hydroprocessing zones in parallel or in series. Resid hydroprocessing includes any process resulting in the hydrogenation of resid and encompasses (but is not limited to) commercially available resid hydroprocessing technologies. Examples of these commercially available processes are the Residfining process, the H-Oil process, the Chevron RDS, VRDS, OCR, and LC-Fining processes, the HYVAHL process, and the ENI-Snamprogetti EST process. The catalyst employed in the typical commercial hydroconversion zone(s) is comprised of material having hydrogenation-dehydrogenation activity together with an amorphous carrier. Exemplary amorphous carriers include alumina, silica-alumina, silica, zirconia, or titania. Hydrogenation-dehydrogenation components of the catalyst preferably comprise at least one hydrogenation component selected from Group VI metals and compounds of Group VI metals and at least one hydrogenation component selected from Group VIII metals and compounds of Group VIII metals. Preferred combinations of hydrogenation components include nickel sulfide with molybdenum sulfide, cobalt sulfide with molybdenum sulfide, cobalt with molybdenum, and nickel with tungsten. The catalyst employed may also be comprised of a material having hydrogenation-dehydrogenation activity formulated without an amorphous carrier. Exemplary catalysts include Nebula® available from Akzo Nobel.

The hydrogen donor-rich hydrocarbon stream typically contains one or more types of naphthenic compounds, which are organic compounds of carbon and hydrogen that contain one or more saturated cyclic (ring) structures, or contain such structures as a major portion of the molecule. The general formula is $C_nH_{2n}$. Naphthenic compounds are sometimes called naphthenes, cycloparaffins or hydrogenated benzenes. The hydrogen content of feeds, reactants and products for present purposes can be measured using any suitable protocol, e.g., ASTM D1018-00(2005) Standard Test Method for Hydrogen in Petroleum Fractions.

In one aspect, the invention includes a process for upgrading tar-containing effluent from a steam cracker furnace comprising the steps of: a) feeding a hydrocarbon feedstock having a final boiling point above 260° C. to a steam cracking furnace containing a radiant section outlet producing a steam cracker tar-containing effluent; b) adding a hydrogen donor-rich hydrocarbon stream comprising naphthenic compounds to at least a portion of the steam cracker tar-containing effluent while the tar-containing effluent is at a temperature of from 200° to 850° C. to form a mixture comprising hydrogen donor-rich hydrocarbons and steam cracker tar-containing effluent; and c) separating the mixture into i) at least one tar-lean product containing a first tar; and ii) a tar-rich product containing a second tar, the tar-rich product having a final boiling point above the final boiling point of the at least one tar-lean product. In one embodiment, step "b)", (e.g., the step of adding a hydrogen donor-rich hydrocarbon stream comprising naphthenic compounds to the steam cracker effluent to form a mixture) is carried out in or upstream of a visbreaker. In still other embodiments, step "c)", (e.g., the step of separating the mixture) is carried out in or downstream of a visbreaker. The visbreaker is preferably operating under visbreaking conditions to visbreak the hydrogen-enriched stream. The visbreaking conditions typically comprise temperatures ranging from 200° to 600° C., total pressures of at least 1135 kPa, and times ranging from 0.01 to 100 hours, e.g., temperatures ranging from 250° to 500° C., total pressures of at least 2169 kPa, and times ranging from 0.1 to 10 hours. Changes in viscosity can be measured for present purposes by any suitable technique known to routineers in the art, including ASTM D445-06 for determining kinematic viscosity of transparent and opaque samples, as well as ASTM D2170 and D2171, used for determining kinematic viscosities of asphalts.

In another embodiment of this aspect, step c) provides a gas as overhead, at least one of a naphtha sidestream and a gas oil sidestream, and a tar bottoms stream. For present purposes, the naphtha sidestream boils below 210° C., say, below 200° C., and the gas oil sidestream boils in a range from 180° to 320° C., say, from 200° to 300° C. The tar bottoms stream can be characterized as having a boiling range of 300° C.+.

In still another embodiment of this aspect of the invention, the tar-rich product of step c) has an asphaltene content no greater than 70 wt. %, say, no greater than 40 wt. %. In still yet another embodiment, step b) is carried out in the presence of steam present in amounts ranging from 1 wt. % to 80 wt. %. In another embodiment, step b) is carried out in, or upstream of, a visbreaker maintained at visbreaking conditions in the presence of steam in amounts ranging from 1 to 80 wt. %.

In still another embodiment, the hydrogen donor-rich hydrocarbon stream is added in an amount ranging from 0.1 to 10 parts by weight per one part by weight of the steam cracker tar in step b), say, from 0.2 to 2 parts by weight per one part by weight of the steam cracker tar in step b). In yet another embodiment, the tar-lean product is separated into A) at least one low temperature boiling range product; and/or B) at least one medium temperature boiling range product. In still yet another embodiment, the asphaltene concentration in the second tar is no greater than a comparative asphaltene concentration in a steam cracker tar within a steam cracker tar-containing effluent treated without adding hydrogen donor-rich hydrocarbon stream in step b).

In yet still another embodiment of this aspect, the process further comprises at least one of: d) adding at least a portion of the at least one tar-lean product to the tar-rich product in an amount sufficient to reduce the viscosity of the tar-rich product; and e) separating any steam and/or water associated with the mixture of step b), heating the recovered steam and/or water, and recycling the steam and/or water to step b) as steam. In another embodiment, the low temperature boiling range product contains less than 1 wt. % asphaltenes, the medium temperature boiling range product contains less than 5 wt. % asphaltenes, and the tar-rich product contains at least 5 wt. % of asphaltenes. In still another embodiment, the low temperature boiling range product boils below 200° C. and the medium temperature boiling range product boils in a range from 200° to 300° C., and the medium temperature boiling range product boils in a range from, say, 300° to 550° C.

In yet another embodiment of this aspect of the invention, the separating is carried out by fractionation, distillation, flashing, extraction, and/or passage through a membrane. In still yet another embodiment of this aspect, at least a portion of the tar-rich product is combusted in a partial oxidation unit. In an embodiment of the apparatus aspect of the invention described in the above "Summary of the Invention," the at least one separator comprises i) at least one outlet for one or more lighter cuts including at least one of an outlet for a naphtha and/or lower-than-naphtha boiling range product and an outlet for a gas oil boiling range product, and ii) at least one outlet for steam cracker tar. In another embodiment of this aspect, the apparatus further comprises a tar knockout drum associated with the convection section of the furnace which comprises i) an inlet for a feedstream from the convection section, ii) an outlet for overheads directed to the convection section, and iii) a bottoms outlet providing a hydrogen donor-rich hydrocarbon stream.

In yet another embodiment of this aspect of the invention, the apparatus further comprises at least one of: f) a line for recycling at least a portion of the at least one tar-lean product and/or the tar-rich product from the at least one separator e) to the at least one transfer line c) and/or the one or more vessels b); g) a line from the at least one outlet for one or more lighter cuts by separator e), to the outlet and/or downstream of the outlet for steam cracker tar, for directing at least a portion of the lighter cuts as fluxant to the steam cracker tar; h) a tar knockout drum upstream of the one or more vessels b), comprising i) an inlet for receiving the steam cracker tar-containing effluent from the furnace a), ii) a bottom outlet for removing tar, and iii) an upper outlet for directing tar-lean effluent to the primary fractionator; i) a partial oxidation unit in communication with at least one of i) the outlet for the tar-rich product containing a second tar, ii) the at least one outlet for steam cracker tar of the separator e), iii) the bottoms outlet of the tar knockout drum h), and iv) the bottoms outlet of the tar knockout drum associated with the convection section of the furnace a); j) a visbreaker as one of the one or more vessels b), comprising a steam cracker tar-containing effluent inlet, an optional hydrogen donor-rich hydrocarbon stream inlet, a gas overhead outlet, an optional naphtha side outlet, an optional gas oil side outlet, and a tar bottoms outlet, wherein the hydrogen donor-rich stream inlet is optionally connected with the bottoms outlet from the tar knockout drum associated with the convection section of the furnace; k) a hydroprocessor for treating tar, located downstream of the bottoms outlet of the tar knockout drum associated with the convection section of the furnace, for treating the hydrogen donor-rich hydrocarbon stream; and 1) a hydroprocessor for treating the feedstock having a final boiling point above 260° C., located upstream of the steam cracking furnace a).

Suitable hydrocarbon feeds for use in the present invention include naphtha boiling range materials, as well as those boiling with a final boiling point in a temperature range from above 180° C., such as feeds heavier than naphtha. Such feeds include those boiling in the range from 93° to 649° C. (from 200° to 1200° F.), say, from 204° to 510° C. (from 400° to 950° F.). Typical heavier than naphtha feeds can include heavy condensates, gas oils, kerosene, hydrocrackates, low sulfur waxy residue, crude, vacuum resid, hydrotreated atmospheric resid, hydrotreated vacuum resid, hydrotreated crude, crude oils, and/or crude oil fractions. The present invention is particularly suited to processing steam cracker feeds that comprise hydrotreated atmospheric resid, hydrotreated vacuum resid, and hydrotreated crude.

The hydrocarbon feeds can comprise a large portion, such as from 5% to 50%, of relatively high-boiling components, i.e., resid. Such feeds could comprise, by way of non-limiting examples, one or more of steam cracker gas oils and residues, gas oils, heating oil, jet fuel, diesel, kerosene, gasoline, catalytically cracked naphtha, hydrocrackate, reformate, raffinate reformate, distillate, virgin naphtha, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, $C_4$'s/residue admixture, naphtha/residue admixture, hydrocarbon gases/residue admixture, hydrogen/residue admixtures, gas oil/residue admixture, and crude oil. Suitable whole crude oils include those containing high levels of nickel and vanadium such as found in Venezuela tars, for example. Solvent deasphalted (or deashpaltened) (SDA) fractions with and without resins, are especially suited for use as feedstocks in the present invention. The foregoing hydrocarbon feeds can have a nominal end boiling point of at least 315° C. (600° F.), generally greater than 510° C. (950° F.), typically greater than 590° C. (1100° F.), for example, greater than 760° C. (1400° F.).

Asphaltenes in steam cracked tar or steam cracker tar can be determined quantitatively as the insolubles in paraffinic solvents. Steam cracked asphaltenes generally are composed of carbon, hydrogen, nitrogen, and sulfur with a C:H atomic ratio of about 2.0-1.0 and average molecular weight of about 1000. They are brownish solids having a vaporization/decomposition temperature starting at 350° C. to 400° C. as determined by thermogravimetric analysis in nitrogen (heating rate 10° C./minute). Among the wide range of paraffin insolubles which are formed upon heating and oxidation, the pentane-insolubles and heptane-insolubles, hereinafter designated as $C_5$-asphaltenes and $C_7$-asphaltenes, are of particular interest. Asphaltenes may be specified with reference to the particular paraffins in which they are insoluble, e.g., n-heptane, n-hexane, n-pentane, isopentane, petroleum ether, etc. For present purposes, asphaltene content of a sample can be determined by well-known analytic techniques, e.g., ASTM D6560 (Standard Test for Determination of Asphaltenes (Heptane Insolubles) in Crude Petroleum and Petroleum Products), ASTM D3270 (Standard Test Method for n-Heptane Insolubles), ASTM D4055-02 Standard Test Method for Pentane Insolubles by Membrane Filtration, and ASTM D-893, Standard Test Method for Insolubles in Used Lubricating Oils.

The hydrocarbon feed may be initially heated by indirect contact with flue gas in a convection section tube bank of the pyrolysis furnace (or cracking furnace) before mixing with a dilution fluid, e.g., steam. Preferably, the temperature of the heavy hydrocarbon feed is from 149° to 260° C. (300° to 500° F.) before mixing with the dilution fluid, preferably water and steam. Following mixing with the primary dilution steam stream, the mixture stream may be heated by indirect contact with flue gas in a first convection section of the pyrolysis furnace before being flashed. Preferably, the first convection section is arranged to add the primary dilution steam stream, between subsections of that section such that the hydrocarbon feeds can be heated before mixing with the fluid and the mixture stream can be further heated before being flashed.

The temperature of the flue gas entering the first convection section tube bank is generally less than 816° C. (1500° F.), for example, less than 704° C. (1300° F.), such as less than 621° C. (1150° F.), and preferably less than 538° C. (1000° F.). Dilution steam may be added at any point in the process. For example, it may be added to the hydrocarbon feedstock before or after heating, to the mixture stream, and/or to the vapor phase. Any dilution steam stream may comprise sour steam. Dilution steam stream may be heated or superheated in a convection section tube bank located anywhere within the convection section of the furnace, preferably in the first or second tube bank. The mixture stream may be at 316° to 538° C. (600° to 1000° F.) before introduction to an optional vapor/liquid separator or flash apparatus, e.g., knockout drum or convection section separator, situated between the convection section inlet and the radiant section of the furnace. The flash pressure can be any suitable pressure, e.g., 275 to 1375 kPa (40 to 200 psia). Following the flash, 50 to 98% of the mixture stream can be in the vapor phase. The vapor phase can be heated above the flash temperature before entering the radiant section of the furnace, for example, to 427° to 704° C. (800° to 1300° F.) This heating may occur in a convection section tube bank, preferably the tube bank nearest the radiant section of the furnace, in the lower convection zone. The bottoms from this vapor/liquid separator are often designated as low sulfur vacuum tower bottoms (LSVTB) and can be directed elsewhere to the process as a hydrogen donor compound source, e.g., in a downstream visbreaker for treating tar streams, particularly where the steam cracker feed has been hydroprocessed prior to entering the steam cracker furnace, e.g., by hydrofining of an atmospheric or vacuum resid feed. Alternately, the LSVTB can be added to a separated steam cracker tar stream upstream of a visbreaker.

The temperature of the gaseous effluent at the outlet from the radiant section of the pyrolysis reactor is normally in the range of from 760° to 929° C. (1400° to 1705° F.). The hot gaseous effluent which contains a steam cracker tar fraction can be cooled by a suitable heat exchange means, e.g., a transfer line exchanger and/or supplemental heat exchanger to a temperature below 300° C. (572° F.), e.g., a temperature below 280° C. (536° F.), or even below 270° C. (518° F.).

The resulting cooled, cracked effluent can be directed to a suitable separation means such as a tar knockout drum prior to further processing in a separation zone. The flash pressure utilized can be any suitable pressure, e.g., from 101 to 1374 kPa (0 to 185 psig). The overhead of the tar knockout drum, containing molecules having boiling points less than 300° C., can be directed to a separation means for further processing, e.g., to a primary fractionator. The bottoms containing tar can be disposed of or directed to a suitable separation means for further processing, e.g., to a primary fractionator. In one embodiment, the bottoms containing tar from the tar knockout drum can themselves be used as at least a portion of the steam cracker tar which is treated in accordance with the invention. In an alternate embodiment, the tar knockout drum is dispensed with, and the steam cracker tar treated by the invention is recovered as bottoms from another separation means, e.g., a primary fractionator, as described below.

The cooled, cracked effluent from the heat exchange means downstream of the pyrolysis reactor which contains a steam cracker tar fraction can be directly taken to a separation zone (bypassing the tar knockout drum, if present). The separation zone can comprise one or more fractionators, one or more extractors, one or more membranes, or combinations thereof. Preferably, the separation zone comprises a primary fractionator. The separation zone divides the stream into one or more tar-lean lighter cuts, e.g., steam cracked naphtha boiling in a range from 10° to 250° C. (50° to 482° F.), say, from 25° to 210° C. (77° to 410° F.), and steam cracked gas oil, boiling in a range from 200° to 300° C. (392° to 572° F.), say, from 210° to 295° C. (410° to 563° F.), as well as a heavy steam cracker tar-rich fraction, typically boiling above 300° C. (572° F.).

The resulting steam cracker tar fraction is collected at a temperature below 300° C. (572° F.), e.g., a temperature below 280° C. (536° F.), or even below 270° C. (518° F.). This steam cracker tar is then treated in accordance with the present invention to enhance its value. This can be done by reducing the ultimate yield of low value steam cracker tar from the process while obtaining increased yields of lighter, more valuable fractions, such as steam cracked gas oil, low sulfur fuel oils, or streams compatible therewith. Moreover, the remaining steam cracker tar provided by the present invention can be reduced in asphaltene content and viscosity. Such reduction in viscosity reduces or eliminates the amount of lower viscosity, higher value flux materials, e.g., steam cracked gas oil, which is necessary to upgrade the steam cracker tar to specification. Additional upgrade value can be achieved by splitting the remaining tar into a light stream and a heavy stream (or a tar-lean stream and a tar-rich stream), where the light stream (tar-lean stream) can be blended into fuel oil without causing incompatibility problems for the resulting blended fuel oil.

While not wishing to be bound by theory, Applicants believe the present invention treats the steam cracker tar in the presence of hydrogen donor-rich hydrocarbon stream comprising naphthenic compounds at a temperature sufficient to crack or otherwise modify asphaltenes and asphaltene precursors into lower boiling molecules. The steam is added to the heating vessel through a steam inlet. Steam can be added to the steam cracker tar at any point in the heating process.

The steam stream utilized may comprise sour steam. The steam stream may be heated or superheated as necessary in a suitable heating means, say, an external heat exchanger, or a convection section tube bank located anywhere within the convection section of the furnace.

The steam cracker tar, typically obtained from a tar knockout drum and/or separation zone, as discussed above, can be heated in the presence of a hydrogen donor-containing hydrocarbon stream and optional steam, at a temperature, pressure, and a time sufficient to stabilize the tar by preventing formation of higher boiling molecules, or convert at least a portion to lower boiling molecules. For present purposes, such a portion can be that part of the steam cracker tar whose conversion to lower boiling molecules can be measured using techniques known to those skilled in the art, e.g., gas chromatography or infrared spectroscopy. Such a portion can range from 0.01 wt. % to 100 wt. %, typically from 1 wt. % to 100 wt. %, say, from 10 wt. % to 100 wt. %, of the steam cracker tar stream that is heated. Such heating is typically carried out downstream of the separation zone and/or tar knockout drum with a suitable heat transfer means, e.g. a furnace, to provide the required heat. Typically, the steam cracker tar can be heated to a temperature above 300° C. (572° F.), say, above 320° C. (608° F.), or even above 350° C. (662° F.), at a pressure ranging from 101 to 2748 kPa (0 psig to 400 psig), say, at a pressure ranging from 101 to 788 kPa (0 psig to 100 psig), and for a period of time of at least 0.01 minutes, say, ranging from 0.01 to 1200 minutes, typically from 0.1 to 120 minutes, or more particularly, from 0.1 to 60 minutes. The amount of time necessary to effect the desired conversion of steam cracker tar to lower boiling molecules can vary depending on such factors as the temperature to which the steam cracker tar is heated, the parts by weight of added hydrogen donor-containing hydrocarbon stream per one part by weight of steam cracker tar, pressure during heating, the weight ratio of steam to hydrocarbon, and the rate of heat transfer to the steam cracker tar, etc. during heating. Thus, if the heating is to occur under flashing conditions, the amount of time needed would be less than that required under, say, heat soak conditions or visbreaking conditions.

Once the steam cracker tar is sufficiently heat treated in the presence of hydrogen donors to reduce asphaltene and other tar molecules content, the hydrogen donor-treated steam cracker tar can be collected as an asphaltene-reduced tar. Preferably, the stream containing the hydrogen donor-treated tar is directed to a suitable separating means, e.g., a primary fractionator, extractor and/or membrane which divides the stream into a plurality of product streams, including a lower temperature boiling range product and a higher temperature boiling range product, the latter containing a tar component. In a typical embodiment, the product streams include at least 1) a steam cracked gas oil (SCGO) stream, boiling in a range from 200° C. (392° F.) to 310° C. (590° F.), say, from 210° C. (410° F.) to 295° C. (563° F.), 2) a low sulfur fuel oil (LSFO)-compatible stream boiling above 300° C. (572° F.) and containing at least 2 wt. % or even at least 5 wt. % asphaltenes boiling above 300° C. (572° F.), and 4) spent steam, if present. In the event it is desired to produce a tar stream similar to one obtained without heat and hydrogen donor-treating according to the invention, the residual stream can be fluxed with a lighter boiling fraction as necessary to provide a tar stream of the same or similar ratio as the untreated tar. The steam cracked gas oil-cut stream of 1) above can be used as the flux. In another embodiment, the visbreaker or other heating vessel can produce SCGO boiling in the range of 180° to 320° C., say, 200° to 300° C., a tar-lean stream and a tar-rich stream. A tar-lean stream contains a lesser proportion of asphaltenes by weight than the asphaltenes in the steam cracker tar that is to be upgraded, say, at least 50 wt. % less, typically at least 75 wt. % less, e.g., at least 90 wt. % less. A tar-rich stream contains a greater proportion of asphaltenes by weight than the asphaltenes in the tar-lean stream, say, at least 50 wt% more, typically at least 75 wt. % more, e.g., at least 90 wt. % more. Suitable visbreaking conditions (including other heat soaking conditions) for the purpose of the invention include temperatures ranging from 300° to 600° C. and pressures ranging from 1482 to 8377 kPa (200 to 1200 psig), say, 400° to 500° C. and pressures ranging from 2172 to 5619 kPa (300 to 800 psig).

In another aspect, the present invention relates to an apparatus for cracking hydrocarbonaceous feed, which comprises: A) a cracking zone comprising a) an inlet for receiving hydrocarbonaceous feed, and b) an outlet for removing hot cracked effluent; B) a heat-exchange zone capable of reducing the temperature of hot cracked effluent to less than 300° C., comprising an inlet for receiving the hot cracked effluent and an outlet for removing a cooled cracked effluent; C) a separation zone of one or more separators comprising an inlet for receiving the cooled cracked effluent, at least one outlet for removing one or more lighter cuts including at least one of an outlet for a naphtha and/or lower-than-naphtha boiling range product and an outlet for a gas oil boiling range product, and at least one outlet for removing steam cracker tar, and further wherein the separation zone C) optionally comprises a primary fractionator; D) a heating zone capable of heating at least a portion of the steam cracker tar to a temperature above 300° C. sufficient to convert at least a portion thereof to lower boiling molecules, comprising an inlet for receiving the steam cracker tar, a hydrogen donor-rich hydrocarbon stream inlet, an optional steam inlet, and an outlet for removing the heated steam cracker tar, the lower boiling molecules and steam; E) an optional line for recycling at least a portion of the heated steam cracker tar and the lower boiling molecules from D) to C); F) at least one optional line from the at least one outlet for removing one or more lighter cuts of C) to the outlet and/or downstream of the outlet for removing the heated steam cracker tar, for directing at least a portion of the lighter cuts to the heated steam cracker tar; G) an optional additional separation zone of one or more separators comprising an inlet for receiving at least a portion of the heated steam cracker tar and any steam and/or water present, at least one outlet for removing one or more lighter cuts, and at least one outlet for removing steam cracker tar; H) optionally, at least one line from at least one outlet for removing one or more lighter cuts of G) to the outlet and/or downstream of the outlet for removing the steam cracker tar, for directing at least a portion of the lighter cuts of G) to the steam cracker tar removed from G); I) an optional tar knockout drum between B) and C), comprising a) an inlet for receiving cracked effluent, b) a bottom outlet for removing tar, and c) an upper outlet for directing tar-lean effluent to the primary fractionator; J) an optional partial oxidation unit in communication with the outlet(s) for a steam cracker tar bottoms product of C) and/or G); K) an optional visbreaker within the heating zone comprising a steam cracker inlet, a hydrogen donor-rich stream inlet, a visbreaker gas overhead outlet, an optional visbreaker naphtha side outlet, an optional visbreaker gas oil side outlet and a visbreaker tar bottom outlet, wherein the hydrogen donor-rich stream inlet is optionally connected with the bottom outlet for removing tar from tar knockout drum I); L) an optional hydroprocessor for treating tar located between the bottom outlet for removing tar from tar knockout drum I) and the hydrogen donor-rich stream inlet of visbreaker K); and M) an optional hydroprocessor for treating the hydrocarbonaceous feed upstream of the cracking zone A).

In other aspects, the invention includes a process for upgrading steam cracker tar containing asphaltenes that comprises: a) heating the steam cracker tar from below 300° C. to a temperature above 300° C., say, at least 350° C., or even at least 400° C., in the presence of an added hydrogen donor-rich hydrocarbon stream comprising naphthenic compounds, such that the final boiling point of the resulting mixture is not greater than that of the steam cracker tar; and b) separating the heated steam cracker tar of a) into i) at least one tar-lean product; and ii) a tar-rich product having a final boiling point above that of the tar-lean product. In another embodiment of the process of the invention, A) the low temperature boiling range product boils below 350° C. and B) the medium temperature boiling range product boils in a range from 250° C. to 600° C., say, A) the low temperature boiling range product boils below 300° C. and B) the medium temperature boiling range product boils in a range from 300° C. to 550° C. In yet another embodiment, at least a portion of the tar-rich product is combusted in a partial oxidation unit. The heating may be carried out to a temperature of at least 300° C., at an overall pressure of at least 101 kPa, with a weight ratio of steam to hydrocarbon of at least 0.1, say, a temperature of at least 350° C., at an overall pressure from 101 to 1010 kPa, and with a weight ratio of steam to hydrocarbon from 0.1 to 4.

In other embodiments, the invention may include a process for upgrading steam cracker tar containing asphaltenes that comprises: a) heating the steam cracker tar from below 300° C. to a temperature above 300° C. in the presence of an added hydrogen donor-rich hydrocarbon stream comprising naphthenic compounds, such that the final boiling point of the resulting mixture is not greater than that of the steam cracker tar; and b) separating the heated steam cracker tar of a) into i) at least one tar-lean product; and ii) a tar-rich product having a final boiling point above that of the tar-lean product.

In other aspects, the invention may include a process for upgrading steam cracker tar which comprises: a) hydroprocessing a resid-containing steam cracker feed; b) heating the hydroprocessed steam cracker feed in an upper convection section of a steam cracker furnace; c) separating the heated feed in a flash drum to provide a bottoms stream and an overhead stream; d) directing the overhead stream to a lower convection section and a radiant section of the steam cracker furnace to provide an olefinic gaseous steam cracker effluent; e) separating the steam cracker effluent into a steam cracker tar bottoms fraction and at least one lower boiling, olefin-containing fraction; f) visbreaking the steam cracker tar in the presence of an added hydrogen donor-rich hydrocarbon stream that can optionally include at least a portion of the bottoms stream from step c) to provide a product of lower viscosity than the steam cracker tar; g) separating the lower viscosity product into at least one of: A) a steam cracker gas oil stream, a light tar stream, and a heavy tar stream, and B) a visbreaker naphtha stream and a visbreaker tar stream; and h) optionally blending the light tar stream and/or the visbreaker tar stream into a fuel oil pool to provide a fuel oil product.

In other embodiments, the present invention may include an apparatus for cracking hydrocarbonaceous feed, which comprises: A) a cracking zone comprising a) an inlet for receiving hydrocarbonaceous feed, and b) an outlet for removing hot cracked effluent; B) a heat-exchange zone capable of reducing the temperature of hot cracked effluent to less than 300° C., comprising an inlet for receiving the hot cracked effluent and an outlet for removing a cooled cracked effluent; C) a separation zone of one or more separators comprising an inlet for receiving the cooled cracked effluent, at least one outlet for removing one or more lighter cuts including at least one of an outlet for a naphtha and/or lower-than-naphtha boiling range product and an outlet for a gas oil boiling range product, and at least one outlet for removing steam cracker tar, and further wherein the separation zone C) optionally comprises a primary fractionator; D) a heating zone capable of heating at least a portion of the steam cracker tar to a temperature above 300° C. sufficient to convert at least a portion thereof to lower boiling molecules, comprising an inlet for receiving the steam cracker tar, a hydrogen donor-rich hydrocarbon stream inlet, an optional steam inlet, and an outlet for removing the heated steam cracker tar, the lower boiling molecules and steam; E) an optional line for recycling at least a portion of the heated steam cracker tar and the lower boiling molecules from D) to C); F) at least one optional line from the at least one outlet for removing one or more lighter cuts of C) to the outlet and/or downstream of the outlet for removing the heated steam cracker tar, for directing at least a portion of the lighter cuts to the heated steam cracker tar; G) an optional additional separation zone of one or more separators comprising an inlet for receiving at least a portion of the heated steam cracker tar and any steam and/or water present, at least one outlet for removing one or more lighter cuts, and at least one outlet for removing steam cracker tar; H) optionally, at least one line from at least one outlet for removing one or more lighter cuts of G) to the outlet and/or downstream of the outlet for removing the steam cracker tar, for directing at least a portion of the lighter cuts of G) to the steam cracker tar removed from G); I) an optional tar knockout drum between B) and C), comprising a) an inlet for receiving cracked effluent, b) a bottom outlet for removing tar, and c) an upper outlet for directing tar-lean effluent to the primary fractionator; J) an optional partial oxidation unit in communication with the outlet(s) for a steam cracker tar bottoms product of C) and/or G); K) an optional visbreaker within the heating zone comprising a steam cracker tar inlet, a hydrogen donor-rich stream inlet, a visbreaker gas overhead outlet, an optional visbreaker naphtha side outlet, an optional visbreaker gas oil side outlet and a visbreaker tar bottom outlet, wherein the hydrogen donor-rich hydrocarbon stream inlet is optionally connected with the bottom outlet for removing tar from tar knockout drum I); L) an optional hydroprocessor for treating tar located between the bottom outlet for removing tar from tar knockout drum I) and the hydrogen donor-rich stream inlet of visbreaker K); and M) an optional hydroprocessor for treating the hydrocarbonaceous feed upstream of the cracking zone A).

In a depiction of one embodiment of the present invention set out in FIG. 1, a hydrocarbon resid-containing feed stream 98 is fed to steam cracker 112, quenched 116, and fed to a primary fractionator 122 for separation and fractionation. In some embodiments, the hydrocarbon feed 98 may be hydroprocessed in reactor 100, wherein hydrogen is added to the hydrocarbon molecules via line 101 in a fixed bed of catalyst comprising Co, Mo, and Ni on alumina to provide a hydrofined resid 102 of reduced sulfur and metals content, with flow rate to the furnace 112 controlled by feed inlet valve 104. The hydrocarbon feed 98 is heated in an upper convection section 105 of a furnace 106. A steam stream and/or water stream (not shown) may be introduced to the hydrocarbons in the upper convection section. The resulting mixture is further heated in the upper convection section where all of the water vaporizes and a large fraction of the hydrocarbon vaporizes. Typically, this heating is carried out to a temperature up to 454° C. (850° F.), e.g., a temperature ranging from 204° to 482° C. (400° to 900° F.).

Exiting upper convection section 105, the mixture stream, generally at a temperature of 454° C. (850° F.) can optionally enter a vapor/liquid separation apparatus or flash drum 103 for use with heavy feeds where a vapor/liquid separation occurs with heavy liquid and resid bottoms being withdrawn or recycled via line 107 to heating vessel 136 (or visbreaker 153 via line 159). The heavy liquid bottoms of line 107 from the vapor/liquid separation apparatus 103, particularly when derived from steam cracking of a hydroprocessed steam cracker feed 102, may provide a hydrogen donor-containing hydrocarbon stream suitable for use in the invention, as above noted. Suitable sources of hydrogen donor compounds, e.g., hydrogen donor-rich hydrocarbon streams, can also be added exclusively or as a supplement to heating vessel 136 via hydrogen donor-rich hydrocarbon stream line 111 and line 107 (designated "HD" to designate hydrogen donor role). Vapor overhead from flash separation device 103 is directed to the convection section in line 109.

The steam/hydrocarbon vapor from the upper convection section (or that derived from the flash drum overhead 109 where a flash drum is used) passes from the lower convection section 108 via crossover piping 110 and through the radiant section 112 of the furnace where it undergoes cracking. The cracked effluent exits the radiant section through a quench header apparatus comprising a transfer line 114 which relays the effluent from the radiant section of the steam cracker to a separation device such as a knockout drum 188 and/or primary fractionator 122. The transfer line 114 may itself comprise an integral heat exchange means or a separate heat exchange means 116 can substitute for or supplement the integral heat exchange means. The heat exchanger(s) reduce the temperature of the cracked effluent to a temperature less than 300° C. (572° F.). A valve 118 controls the flow of cooled cracked effluent via line 120 to a (primary) fractionator 122. Steam can optionally be added to the steam cracker tar-containing effluent in transfer line 114 through line 119, preferably downstream of the location where the quench inlet 184 joins the transfer line 114. The steam can be added in an amount sufficient to provide a steam to hydrocarbon ratio of 0.1 to 4. The steam may, in addition to the hydrogen-donor components, also serve to help hydrogenate the steam cracker effluent. The overall pressure in the effluent transfer line 114 can be maintained within the range of 101 to 1010 kPa. The steam can be obtained from any suitable source, e.g., high pressure steam, medium pressure steam, and sour steam. For purposes of the present invention, the term "steam cracker tar-containing effluent" includes any resid or tar-containing portion of the effluent from the steam cracker furnace, including any such effluent or resid or tar-containing portion thereof prior to fractionation, as well as steam cracker tar-containing fractions which have been separated from the steam cracker furnace effluent by tar-knockout, fractionation, or other resid generating fraction/separation process, as well as by any other suitable post-furnace separation means such as flash separation.

In some embodiments, such as illustrated in FIG. 1, a vapor stream containing $C_4^-$ hydrocarbons is taken as overhead via line 124 from primary fractionator 122, while steam cracked naphtha is taken as an upper side stream via line 126 controlled by valve 128, and a steam cracked gas oil fraction is taken as a lower side stream via line 130, controlled by valve 132. Steam cracker tar is taken as a bottoms fraction having a temperature below 300° C. (572° F.) via line 134. In one embodiment, the steam cracker tar is directed to a heating vessel 136, which may be, for example a heat soaking vessel comprising a heating means 138, e.g., a furnace or heating element, where the steam cracker tar is heated by vessel 136 to a temperature of at least 300° C. (572° F.), e.g., above 350° C. (662° F.), say, 400° C. (752° F.), with a residence time of from 0.1 to 60 minutes. Steam at a temperature above 300° C. (572° F.) can optionally be added to the heating vessel via line 135 in an amount sufficient to provide a steam to hydrocarbon (bottoms fraction) ratio of 0.1 to 4. The overall pressure in the heating vessel may be maintained within the range of 101 to 1010 kPa. The steam can be obtained from any suitable source, e.g., high pressure steam, medium pressure steam, and sour steam. In one embodiment, heat soaking conditions are maintained in the vessel including temperatures from 200° to 600° C., total pressures no greater than 1138 kPa (150 psig), say, no greater than 448 kPa (50 psig), e.g., no greater than 101 kPa (0 psig), and heat soaking times ranging from 0.01 to 100 hours. As noted above, a hydrogen donor-rich hydrocarbon stream generated within the inventive process and/or apparatus, e.g., a low sulfur vacuum tower bottoms, can be supplemented or substituted by an external source of hydrogen donors via line 111. In one embodiment, a hydroprocessing zone 131 fed by hydrogen line 133, e.g., a hydrofinishing reactor, may be used for further hydrotreatment of the hydrogen donor-rich hydrocarbon stream in line 107 upstream of the heating vessel 136.

In some embodiments, a portion of the steam cracker tar from the primary fractionator 122 can be directed from line 134 via line 140 controlled by valve 142 to a partial oxidation unit (POX) 144, which is widely utilized in the chemical and petroleum industries to convert heavy hydrocarbons to synthetic gas. Thus, the untreated steam cracker tar can be utilized as POX feedstock.

At least a portion of the heat and hydrogen donor-rich treated steam cracker tar may be directed from line 134 via line 146 controlled by valve 148 to a separating means, e.g., fractionator 150 via line 152 controlled by valve 154. As desired, the treated steam cracker tar can be collected directly from line 146 via line 156 controlled by valve 158. If necessary, the treated steam cracker tar in line 146 can be diluted or fluxed with a diluent, e.g., steam cracked naphtha taken from line 126 via line 160 controlled by valve 162, and/or a steam cracked gas oil stream taken from line 130, via line 164 controlled by valve 166. Steam cracked gas oil can be directed to the heating vessel 136 via lines 163 and 202.

In some embodiments, the steam cracker tar bypasses the heat soaking vessel 136 via lines 147 and 146 to line 152 where it is directed via line 151 to visbreaker 153. Steam can be added at a suitable location to the steam cracker tar-containing effluent in the visbreaker 153, e.g., via line 155. The steam can be added in an amount sufficient to provide a steam to hydrocarbon ratio of 0.1 to 4. The overall pressure in the line can be maintained within the range of 101 to 8080 kPa. The steam can be obtained from any suitable source, e.g., high pressure steam, medium pressure steam, and sour steam. A hydrogen donor-rich hydrocarbon stream is added to visbreaker 153 via line 159. As earlier noted, a suitable source of hydrogen donor-rich hydrocarbons can be taken from heavy liquid bottoms of the vapor/liquid separation apparatus 103, (separation/fractionation tower or vessel bottoms) particularly when such bottoms are derived from steam cracking of a hydroprocessed steam cracker feed, e.g., hydrotreated vacuum tower resids.

Visbreaking conditions suitable for this embodiment include 300° to 600° C., at pressures ranging from 1482 to 8377 kPa (200 to 1200 psig). Sufficient visbreaking for present purposes can be determined by suitable criteria such as residence time, viscosity measurement of visbreaker effluent, and final boiling point of visbreaker effluent. When sufficient time has passed for desired visbreaking to occur, the visbroken product is directed via lines 157 and 152 to the fractionator 150.

The primary fractionator 150 resolves the heat- and hydrogen donor-rich hydrocarbon stream-treated steam cracker tar stream into an overhead stream of naphtha and lighter materials, as well as entrained steam/water (if present) via line 167 to a condenser 171 for separating out steam/water for recycle to heating vessel 136 via line 173 through heater 169 (to convert water to steam) and steam injection inlet 135. Alternately, the steam/water can be recycled to visbreaker 153. Naphtha and lighter materials are taken from the condenser 171 via line 175. Similarly, a steam cracked gas oil stream with entrained steam/water is taken as an upper side stream via line 168 to a condenser 177 for separating out steam/water for recycle via lines 179 and 173. Steam cracked gas oil is taken from the condenser 177 via line 181. A low sulfur fuel oil-compatible stream is taken as a lower side stream of fractionator 150 via line 170 and can be added to a fuel oil pool to provide a fuel oil product. A low value tar stream rich in asphaltenes can be collected as bottoms via line 172 controlled by valve 174. If desired, the tar stream can be directed to partial oxidizer 144 via line 176 controlled by valve 178. The low value tar stream can be fluxed by adding a diluent such as a steam cracked gas oil stream, e.g., by diverting at least a portion of the steam cracked gas oil stream to line 172 from line 168 via line 180 which is controlled by valve 182. At least a portion of the heat- and hydrogen donor-treated steam cracker tar can be recycled to the fractionator 122 via line 184 controlled by valve 186 to effect separation of lower boiling, more valuable components resulting from the heat- and hydrogen donor-treatment of the steam cracker tar.

Optionally, at least a portion of the cooled cracked effluent in line 120 can be diverted to a tar knockout drum 188 via line 190 (which for present purposes can be considered a portion of a transfer line) controlled by valve 192. Overhead is taken from the drum and directed to fractionator 122 via line 194 controlled by valve 196. A steam cracker tar fraction can be taken as bottoms via line 198 controlled by valve 200. Optionally, at least a portion of the tar fraction can be sent directly to the heating vessel 136 via line 202 controlled by valve 204. Alternately, the steam cracker tar fraction can be directed via lines 202 and 206 to line 146 and thence via line 152 and line 151 to visbreaker 153, bypassing the heating vessel 136. Steam cracker gas oil can be added to the steam cracker tar fraction as flux via line 164. Steam can be directed into the tar knockout drum via line 187, preferably at a location downstream of an alternate quench inlet fed by line 185 which can be fed with a suitable quench medium, e.g., quench oil derived from the primary fractionator bottoms taken via line 137 to the transfer line 120. Steam can be added directly to the tar knockout drum 188 via line 189. Visbreaker effluent is directed via line 157 and 152 from the visbreaker 153 to fractionator 150 where it can be separated into a visbreaker steam cracked gas oil stream taken via line 168 and a visbreaker light tar stream (tar-lean stream) taken via line 170 and a visbreaker heavy tar stream (tar-rich stream) taken as bottoms via line 172. Hydrogen donor-rich hydrocarbons are directed to the visbreaker 153 via line 159 (designated "HD") and can be supplied from the bottoms of the knockout drum 103 via line 107, if desired. The light tar stream (tar-lean stream) can be added to a fuel oil pool to provide a fuel oil product while the heavy tar stream (tar-rich stream) can be directed to the partial oxidation reactor 144 for further processing.

TABLE 1 below sets out the respective fractions present in a typical untreated steam cracker tar and fractions present after a sample of the same tar is heat-treated at 450° C., or heat-treated in accordance with the present invention in the presence of 25 wt. % tetralin as hydrogen donor compound at 450° C. at 2861 kPa (400 psig). In this test, the reactor was a 1.9 cm (¾") stainless steel tubing placed inside a sand bath maintained at 450° C. A mixture of 75 wt. % tar and 25 wt. % tetralin was loaded batch-wise into the reactor before being placed in the sand bath. At the end of the 15 minute run length, the reactor was removed from the sand bath and cooled in an ice bath. The hydrocarbon product was removed from the reactor and analyzed for boiling point distribution and concentrations of asphaltenes and coke. The results show that addition of hydrogen donor compound significantly decreases asphaltenes produced.

TABLE 1

| Fraction | BOP Tar, wt. % | Tar @ 450° C., 2861 kPa | 75% Tar/25% Tetralin @ 450° C., 2861 kPa |
|---|---|---|---|
| <293° C. | 21 | 27 | 32 |
| 293°-566° C. | 41 | 40 | 46 |
| >566° C. | 15 | 9 | 8 |
| Asphaltenes | 23 | 24 | 14 |

The present invention is especially suited to economically advantageous use of steam cracker tars by treating them in the presence of hydrogen donor compounds to prevent or reduce formation of asphaltenes and other tar molecules. The overall yield of tar produced by steam cracking can be reduced significantly by the invention and the tar produced can be used as a blending component of fuel oil pools.

While the present invention has been described and illustrated by reference to particular embodiments, those of ordinary skill in the art will appreciate that the invention lends itself to variations not necessarily illustrated herein. For this reason, reference should be made solely to the appended claims for purposes of determining the true scope of the present invention.

In other embodiments, the invention may include:

1. A process for upgrading tar-containing effluent from a steam cracker furnace comprising: a) feeding a hydrocarbon feedstock having a final boiling point above 260° C. to a steam cracking furnace containing a radiant section outlet producing a steam cracker tar-containing effluent; b) adding a hydrogen donor-rich hydrocarbon stream comprising naphthenic compounds to at least a portion of the steam cracker tar-containing effluent while the tar-containing effluent is at a temperature of from 200° to 850° C. to form a mixture comprising hydrogen donor-rich hydrocarbons and steam cracker tar-containing effluent; and c) separating the mixture into i) at least one tar-lean product containing a first tar and ii) a tar-rich product containing a second tar, the tar-rich product having a final boiling point above the final boiling point of the at least one tar-lean product.
2. The process of paragraph 1, wherein the hydrogen donor-rich hydrocarbon stream is selected from the group consisting of light cycle oil, hydrofined product streams, tetralin, alkyl substituted tetralin, hydrogenated anthracenes, hydrogenated phenanthrenes, hydrogenated pyrenes, bottoms separated from a hydrotreated resid, hydrotreated vacuum tower bottoms, and hydrotreated low sulfur vacuum tower bottoms.
3. The process according to any of the preceding paragraphs, wherein the hydrotreated resid is a steam cracker feed.
4. The process according to any of the preceding paragraphs, wherein step b) is carried out in, or upstream of, a visbreaker under visbreaking conditions, say, temperatures ranging from 200° C. to 600° C., total pressures of at least 1135 kPa and times ranging from 0.01 to 100 hours, e.g., temperatures ranging from 250° to 500° C., total pressures of at least 2169 kPa and times ranging from 0.1 to 10 hours.

5. The process according to any of the preceding paragraphs, wherein step c) provides a gas as overhead, at least one of a naphtha sidestream and a gas oil sidestream, and a tar bottoms stream.

6. The process according to any of the preceding paragraphs, wherein the tar-rich product of step c) has an asphaltene content no greater than 70 wt. %, say, no greater than 40 wt. %.

7. The process according to any of the preceding paragraphs wherein step b) is carried out in the presence of steam present in amounts ranging from 1 wt. % to 80 wt. %.

8. The process according to any of the preceding paragraphs wherein hydrogen donor-rich hydrocarbon stream is added in an amount ranging from 0.1 to 10 parts by weight per one part by weight of the steam cracker tar in step b).

9. The process according to any of the preceding paragraphs, wherein the tar-lean product is separated into A) at least one low temperature boiling range product; and/or B) at least one medium temperature boiling range product.

10. The process according to any of the preceding paragraphs, which further comprises at least one of: d) adding at least a portion of the at least one tar-lean product to the tar-rich product in an amount sufficient to reduce the viscosity of the tar-rich product; and e) separating any steam and/or water associated with the mixture of step b), heating the recovered steam and/or water, and recycling the steam and/or water to step b) as steam.

11. The process according to paragraph 9, wherein the low temperature boiling range product contains less than 1 wt. % asphaltenes, the medium temperature boiling range product contains less than 5 wt. % asphaltenes, and the tar-rich product contains at least 5 wt. % of asphaltenes; and further, wherein the low temperature boiling range product boils below 200° C. and the medium temperature boiling range product boils in a range from 200° C. to 300° C.

12. The process according to any of the preceding paragraphs, wherein the separating is carried out by fractionation, flashing, extraction, and/or passage through a membrane.

13. The process according to any of the preceding paragraphs, wherein at least a portion of the tar-rich product is combusted in a partial oxidation unit.

14. A process for upgrading steam cracker tar which comprises: a) hydroprocessing a resid-containing steam cracker feed; b) heating the hydroprocessed steam cracker feed in an upper convection section of a steam cracker furnace; c) separating the heated feed in a flash drum to provide a bottoms stream and an overhead stream; d) directing the overhead stream to a lower convection section and a radiant section of the steam cracker furnace to provide a steam cracker effluent; e) separating the steam cracker effluent into a steam cracker tar bottoms fraction and at least one lower boiling, olefins-containing fraction; f) visbreaking the steam cracker tar in the presence of an added hydrogen donor-rich hydrocarbon stream that can optionally include at least a portion of the bottoms stream from step c), to provide a product of lower viscosity than the steam cracker tar; g) separating the product of lower viscosity into at least one of: a steam cracker gas oil stream, a tar-lean stream, and a tar-rich stream; and h) optionally blending the tar-lean stream and/or the tar-rich stream into a fuel oil pool to provide a fuel oil product.

15. An apparatus for upgrading tar-containing effluent from a steam cracker furnace comprising: a) a steam cracker furnace useful for cracking a feedstock having a final boiling point above 260° C., the furnace having a convection section and a radiant section with an outlet for discharging a steam cracker tar-containing effluent from the furnace; b) one or more vessels downstream of the radiant section outlet for further processing the steam cracker tar-containing effluent at temperatures from 200° to 850° C.; c) at least one transfer line for conveying the steam cracker tar-containing effluent from the furnace to or between the one or more vessels downstream of the radiant section outlet; d) at least one line for adding a hydrogen donor-rich hydrocarbon stream to the steam cracker tar-containing effluent downstream from the furnace through a hydrogen donor-rich hydrocarbon stream inlet into the at least one transfer line and/or the one or more vessels, to form a mixture comprising hydrogen donor-rich hydrocarbons and steam cracker tar-containing effluent; and e) at least one separator for separating the mixture into i) at least one tar-lean product containing a first tar; and ii) a tar-rich product containing a second tar, the tar-rich product having a final boiling point above the final boiling point of the at least one tar-lean product, and further wherein the at least one separator optionally comprises a primary fractionator.

16. The apparatus of paragraph 15, wherein the at least one separator comprises i) at least one outlet for one or more lighter cuts including at least one of an outlet for a naphtha and/or lower-than-naphtha boiling range product and an outlet for a gas oil boiling range product, and ii) at least one outlet for steam cracker tar.

17. The apparatus according to any of preceding paragraphs 15 and 16 which further comprises a tar knockout drum associated with the convection section of the furnace which comprises i) an inlet for a feedstream from the convection section, ii) an outlet for overheads directed to the convection section, and iii) a bottoms outlet providing a hydrogen donor-rich hydrocarbon stream.

18. The apparatus according to any of preceding paragraphs 15, 16, and 17 which further comprises at least one of: f) a line for recycling at least a portion of the at least one tar-lean product and/or the tar-rich product from the at least one separator e) to the at least one transfer line c) and/or the one or more vessels b); g) a line from the at least one outlet for one or more lighter cuts by separator e), to the outlet and/or downstream of an outlet for steam cracker tar, for directing at least a portion of the lighter cuts as fluxant to the steam cracker tar; h) a tar knockout drum upstream of the one or more vessels b), comprising i) an inlet for receiving the steam cracker tar-containing effluent from the furnace a), ii) a bottom outlet for removing tar, and iii) an upper outlet for directing tar-lean effluent to the primary fractionator; i) a partial oxidation unit in communication with at least one of i) the outlet for the tar-rich product containing a second tar, ii) the at least one outlet for steam cracker tar of the separator e), iii) the bottoms outlet of the tar knockout drum h), and iv) the bottoms outlet of the tar knockout drum associated with the convection section of the furnace a); j) a visbreaker as one of the one or more vessels b), comprising a steam cracker tar-containing effluent inlet, an optional hydrogen donor-rich hydrocarbon stream inlet, a gas overhead outlet, an optional naphtha side outlet, an optional gas oil side outlet, and a tar bottoms outlet, wherein the hydrogen donor-rich stream inlet is optionally connected with the bottoms outlet from the tar knockout drum associated with the convection section of the furnace; k) a hydroprocessor for treating tar, located downstream of the bottoms outlet of the tar knockout drum associated with the convection section of the furnace, for treating the hydrogen donor-rich hydrocarbon stream; and 1) a hydroprocessor for treating the feedstock having a final boiling point above 260° C., located upstream of the steam cracking furnace a).

What is claimed is:

1. A process for upgrading steam cracker tar comprising:

a) hydroprocessing a resid-containing steam cracker feed;

b) heating the hydroprocessed steam cracker feed in an upper convection section of a steam cracker furnace;

c) separating the heated feed in a flash drum to provide a bottoms stream and an overhead stream;

d) directing the overhead stream to a lower convection section and a radiant section of the steam cracker furnace to provide a steam cracker effluent;

e) separating the steam cracker effluent into a steam cracker tar bottoms fraction and at least one lower boiling, olefins-containing fraction;

f) visbreaking the steam cracker tar in the presence of an added hydrogen donor-rich hydrocarbon stream that can optionally include at least a portion of the bottoms stream from step c), to provide a product of lower viscosity than the steam cracker tar;

g) separating the product of lower viscosity into at least one of: a steam cracker gas oil stream, a tar-lean stream, and a tar-rich stream; and h) optionally blending the tar-lean stream and/or the tar-rich stream into a fuel oil pool to provide a fuel oil product.

2. The process of claim 1, wherein the hydrogen donor-rich hydrocarbon stream is selected from light cycle oil, hydrofined product streams, tetralin, alkyl substituted tetralin, hydrogenated anthracenes, hydrogenated phenanthrenes, hydrogenated pyrenes, bottoms separated from a hydrotreated resid, hydrotreated vacuum tower bottoms, and hydrotreated low sulfur vacuum tower bottoms.

3. The process of claim 2, wherein the hydrotreated resid is a steam cracker feed.

4. The process of claim 1, wherein the visbreaking conditions comprise temperatures ranging from 200° C. to 600° C., total pressures of at least 1135 kPa and times ranging from 0.01 to 100 hours.

5. The process of claim 1, wherein step g) further provides a gas as overhead and at least one of a naphtha sidestream and a gas oil sidestream.

6. The process of claim 1, wherein the tar-rich stream of step g) has an asphaltene content no greater than 70 wt. %.

7. The process of claim 6, wherein the tar-rich stream of step g) has an asphaltene content no greater than 40 wt. %.

8. The process of claim 1, wherein hydrogen donor-rich hydrocarbon stream is added in an amount ranging from 0.1 to 10 parts by weight per one part by weight of the steam cracker tar in step b).

9. The process of claim 1, wherein the tar-lean stream is separated into A) at least one low temperature boiling range product; and/or B) at least one medium temperature boiling range product.

10. The process of claim 9, wherein the low temperature boiling range product contains less than 1 wt. % asphaltenes, the medium temperature boiling range product contains less than 5 wt. % asphaltenes, and the tar-rich product contains at least 5 wt. % of asphaltenes.

11. The process of claim 9, wherein the low temperature boiling range product boils below 350° C. and the medium temperature boiling range product boils in a range from 250° C. to 600° C.

12. The process of claim 9, wherein the low temperature boiling range product boils below 200° C. and the medium temperature boiling range product boils in a range from 200° C. to 300° C.

13. The process of claim 1, wherein the asphaltene concentration in the tar-rich stream is no greater than a comparative asphaltene concentration in a steam cracker tar within a steam cracker tar-containing effluent treated without adding hydrogen donor-rich hydrocarbon stream in step b).

14. The process of claim 1 further comprising at least one of:

a) adding at least a portion of the at least one tar-lean stream to the tar-rich stream in an amount sufficient to reduce the viscosity of the tar-rich stream; and b) separating any steam and/or water associated with the mixture of step b), heating the recovered steam and/or water, and recycling the steam and/or water to step b) as steam.

15. The process of claim 1, wherein the separating step e) includes fractionation, distillation, flashing, extraction, and/or passage through a membrane.

16. The process of claim 1, wherein at least a portion of the tar-rich stream is combusted in a partial oxidation unit.

17. The process of claim 1, wherein step f) is carried out in the presence of steam present in amounts ranging from 1 wt % to 80 wt %.

* * * * *